US008419157B2

(12) United States Patent
Paschkewitz et al.

(10) Patent No.: US 8,419,157 B2
(45) Date of Patent: Apr. 16, 2013

(54) APPARATUS FOR CONTROLLED FREEZING OF MELTED SOLID INK IN A SOLID INK PRINTER

(75) Inventors: John S. Paschkewitz, San Carlos, CA (US); Eric J. Shrader, Belmont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 310 days.

(21) Appl. No.: 12/714,031

(22) Filed: Feb. 26, 2010

(65) Prior Publication Data

US 2011/0211010 A1 Sep. 1, 2011

(51) Int. Cl.
*B41J 29/377* (2006.01)
*B41J 2/175* (2006.01)

(52) U.S. Cl.
USPC ..... 347/18; 347/88

(58) Field of Classification Search ..... 347/18, 347/88
See application file for complete search history.

(56) References Cited

U.S. PATENT DOCUMENTS

| | | | |
|---|---|---|---|
| 3,636,605 | A | 1/1972 | Vitcha et al. |
| 4,126,868 | A | 11/1978 | Kirner |
| 4,318,437 | A | 3/1982 | Kemp |
| 4,380,770 | A | 4/1983 | Maruyama |
| 4,517,577 | A | 5/1985 | Miranda et al. |
| 4,682,644 | A | 7/1987 | Ueno |
| 4,905,752 | A | 3/1990 | Rama Prasad |
| 4,981,166 | A | 1/1991 | Brown et al. |
| 5,105,209 | A | 4/1992 | Koto et al. |
| 5,205,340 | A | 4/1993 | Brown et al. |
| 5,271,451 | A | 12/1993 | Chandley et al. |
| 5,557,305 | A | 9/1996 | Hine et al. |
| 5,621,444 | A | 4/1997 | Beeson |
| 5,757,390 | A | 5/1998 | Gragg et al. |
| 6,007,193 | A | 12/1999 | Kashimura et al. |
| 6,176,573 | B1 | 1/2001 | Barth et al. |
| 6,196,672 | B1 * | 3/2001 | Ito et al. ..... 347/88 |
| 6,257,715 | B1 | 7/2001 | Thielman et al. |
| 6,530,658 | B1 | 3/2003 | Pham |
| 7,144,100 | B2 | 12/2006 | Hill et al. |
| 7,188,941 | B2 | 3/2007 | Platt et al. |
| 7,296,612 | B2 | 11/2007 | Bend |

(Continued)

FOREIGN PATENT DOCUMENTS

| | | |
|---|---|---|
| EP | 0 390 202 A2 | 10/1990 |
| EP | 0 571 127 A2 | 11/1993 |
| EP | 1 935 651 A1 | 6/2008 |
| EP | 2 216 177 A1 | 8/2010 |

OTHER PUBLICATIONS

Rafael Nariman, "Steel Casting Design Considerations", Material Matters, Fall 2004.

European Search Report corresponding to European Application No. EP 11 15 4464.9, mailed Jan. 31, 2012 (6 pages).

*Primary Examiner* — An Do

(74) *Attorney, Agent, or Firm* — Maginot, Moore & Beck, LLP

(57) ABSTRACT

An apparatus controls dissipation of heat from melted ink within a component storing melted ink within a solid ink imaging device. The apparatus includes a housing, a passage within the housing that is configured to store melted ink, and a temperature control connector mechanically coupled to the housing and passage, the temperature control connector being configured to mitigate void formation in melted ink as the melted ink cools in the passage.

15 Claims, 4 Drawing Sheets

U.S. PATENT DOCUMENTS

| | | | |
|---|---|---|---|
| 7,413,299 | B2 | 8/2008 | Reeves |
| 2008/0129808 | A1 | 6/2008 | Platt et al. |
| 2008/0149189 | A1 | 6/2008 | Jones et al. |
| 2009/0066747 | A1 | 3/2009 | Hays et al. |
| 2009/0102906 | A1 | 4/2009 | Phillips et al. |
| 2009/0244225 | A1 | 10/2009 | Hays et al. |

* cited by examiner

APPARATUS FOR CONTROLLED FREEZING OF MELTED SOLID INK IN A SOLID INK PRINTER

TECHNICAL FIELD

The devices and methods disclosed below generally relate to solid ink imaging devices, and, more particularly, to solid ink imaging devices that permit melted ink to solidify in a print head of the solid ink imaging device.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a melt plate in the heater assembly. The melt plate melts the solid ink impinging on the plate into a liquid that is delivered to an ink reservoir which maintains the ink in melted form for delivery to a print head for jetting onto a recording medium.

One difficulty faced during operation of solid ink printers is the electrical energy consumed by the printer. In particular electrical energy is required for the melting device to convert the solid ink to melted ink and print heads also require electrical energy to maintain the melted ink in the liquid phase. In an effort to conserve energy, solid ink printers are operated in various modes that consume different levels of energy. In these various modes, one or more components that include heaters to maintain melted ink in the liquid phase may be shut off to enable the melted ink to "freeze" or return to the solid state.

One problem that arises from the freezing of melted ink is the formation of bubbles in the solidified ink. These entrapped bubbles must be purged when electrical energy is coupled to the components to liquefy the solidified ink. The purging operation, however, results in the discarding of ink from the printing system. Customers generally view the loss of ink as being undesirable. Thus, enabling the solidification of melted ink without the formation of entrapped bubbles in the solidified ink would be useful.

SUMMARY

An apparatus has been developed that enables melted ink in a print head to solidify with little or no formation of bubbles in the solidified ink. The apparatus includes a housing, a passage within the housing that is configured to store melted ink, and a temperature control connector mechanically coupled to the housing and passage, the temperature control connector being configured to mitigate void formation in melted ink as the melted ink cools in the passage.

A print head has also been developed that enables melted ink in a reservoir of a print head to solidify with little or no formation of bubbles in the solidified ink. The print head includes a housing, a reservoir within the housing that is configured to store melted ink for ejection from the print head, and a thermal conductor that is thermally coupled to the melted ink within the reservoir to control solidification of the melted ink within the reservoir in response.

BRIEF DESCRIPTION OF THE DRAWINGS

The foregoing aspects and other features of the present disclosure are explained in the following description, taken in connection with the accompanying drawings.

DETAILED DESCRIPTION

The term "printer" as used herein refers, for example, to reproduction devices in general, such as printers, facsimile machines, copiers, and related multi-function products. While the specification focuses on a system that controls the solidification process of phase-change ink in a printer, the system may be used with any phase-change ink image generation device. Solid ink may be called or referred to as ink, ink sticks, or sticks. The term "via" as used herein refers to any passage that conveys ink from one chamber to another chamber.

Figure 1:
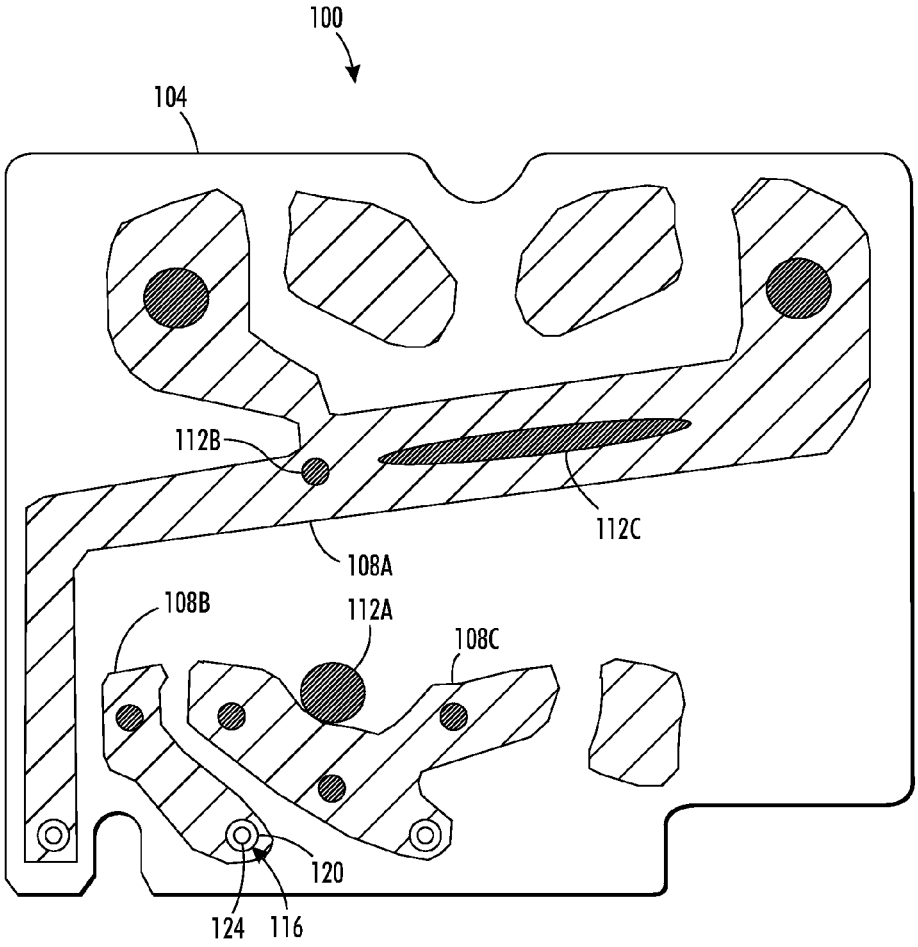
FIG. 1 is a partial cross-sectional view of a print head housing containing multiple passages for ink.

An example of a print head housing that mitigates bubble formation in solidified ink held in the print head is depicted in the cross-sectional view of FIG. 1. The print head 100 has a housing 104, typically made of a metal, such as stainless steel or aluminum, or a polymer material. Within the housing 104 are one or more chambers that hold ink as exemplified by chambers 108A, 108B, and 108C. These chambers may be in fluid communication with one another through a passage not visible at the location of the cross-section. The chambers may have various shapes and sizes as determined by the requirements for ink flow through each print head 100. In the print head of FIG. 1, various thermal conductors 112A-C are disposed within and about the chambers 108A-C. Each thermal conductor 112 passes through housing 104 and connects to the exterior of the housing 104. The thermal conductors 112 act as temperature control connectors that control the rate of heat transfer from ink disposed within each chamber 108 to the exterior of housing 104. As used herein, thermal conductor refers to a material having a relatively high coefficient of thermal conductivity, k, which enables heat to flow through the material across a temperature differential. In FIG. 1, the thermal conductors 112 are positioned so that the various regions of each chamber 108 have an approximately equal thermal mass. For example, thermal conductor 112C bifurcates the surrounding ink channel in chamber 108A, forming two regions with roughly equivalent thermal masses. Depending upon the desired rate of heat transfer, some or all of the thermal conductors 112 may connect to heat sinks (not shown) external to housing 104. The heat sinks are typically metallic plates that may optionally have metallic fins that aid in radiating conducted heat away from print head 100.

Depending upon the desired heat conduction characteristics, thermal conductors may be of various shapes and sizes. In FIG. 1, thermal conductor 112A is cylindrical in shape, while thermal conductor 112B is also cylindrical with different diameter. Thermal conductors may also have a variety of shapes such as the oblique form of thermal conductor 112C. A thermal conductor may be placed proximate to an ink chamber such as thermal conductor 112A or placed within an ink reservoir as with thermal conductors 112B and 112C. The thermal conductors may be formed from various thermally conductive materials, with copper being one preferred material. In designing the thermal conductors, the particular material used may be influenced by the desired thermal conductivity for each thermal conductor, so alternative print heads may use other materials with differing thermal conductivity including different metals or thermoplastics, and may employ thermal conductors formed of two or more materials in a single print head housing. The precise size, shape, and position of thermal conductors are selected to affect either the time needed for a thermal mass to solidify, the direction in which solidification takes place, or both. Because the ink affects heat distribution in the print head, appropriate selection and placement of thermal conductors help to control the temperature of the ink so the ink is more likely to cool and solidify without forming voids.

The following equation governs the characteristic time for conduction for a given thermal mass of ink:

$$t_{eff} \approx \frac{L^2}{\alpha} = \frac{L^2 k}{\rho C_p} \qquad \text{Equation 1}$$

In Equation 1, the characteristic time $t_{eff}$ of thermal conduction for a thermal mass is expressed as the ratio of a characteristic dimension, L, to the thermal diffusivity, $\alpha$, of the mass. The characteristic dimension, L, of the thermal mass is related to the volume to surface area ratio (V/A) of the thermal mass. For a sphere, V/A can be approximated by the radius or diameter, while for a cube it is the length of a side. Objects with large surface areas and small volumes have a small characteristic length for thermal conduction and cool much faster than objects with small surface areas and large volumes. As an example, the center of a sphere with radius 2R takes roughly 4 times as long to reach a given temperature than the center of a sphere of radius R. Although modifying the heat capacity or the thermal conductivity of the ink or surrounding material can also affect the time to change temperature, using thermal conductors to alter the volume to surface area ratio is a more effective way of controlling heat distribution in a print head due to the nonlinear relationship between conduction path length and thermal response time.

The thermal conductors are placed in a manner that produces a desired $t_{eff}$ for each thermal mass of melted ink present in a print head. To be effective, thermal conductors need to be positioned to enable an effective cooling length of the thermal mass to be the same as the smallest characteristic dimension in a passageway leading into or out of the chamber. Likewise, as noted above, the thermal conductors may be used to alter the volume to surface area ratio appropriately. Alternatively, a thermal conductor needs to provide a local temperature that enables a thicker mass to cool equivalently as a smaller mass experiencing a higher temperature gradient. In the embodiment of FIG. 1, $t_{eff}$ time values for the ink in the portions of the print head near the print head's narrow vias 116 are shorter than the $t_{eff}$ time values in the chambers or the larger passages through the print head. Thus, the thermal conductors are positioned to equalize the thermal mass in the various portions of a chamber, to promote equalization of the time for the ink in the various portions of the print head 100 to solidify, or to encourage the freezing to occur in a direction that enables air bubbles or voids to be released from the solidifying ink.

Continuing to refer to FIG. 1, one or more vias 116 convey ink to and from the chambers 108 in the print head 100. The vias 116 in FIG. 1 have a shape that is wider at the opening 120 at one end of the via 116 and which tapers to a narrower opening 124 at the other end of the via. The direction of the taper is selected to control how ink in the via 116 solidifies as it cools. The taper acts as a different form of temperature control connector, allowing the ink in the via 116 to cool in a predictable manner. The preferred selection is for the narrow end of each via to be disposed towards the portion of the print head where ink should solidify first, since the narrower portions of the via 116 have a lower thermal mass of ink that is likely to solidify before the ink in the wider portions of the via.

Figure 2:
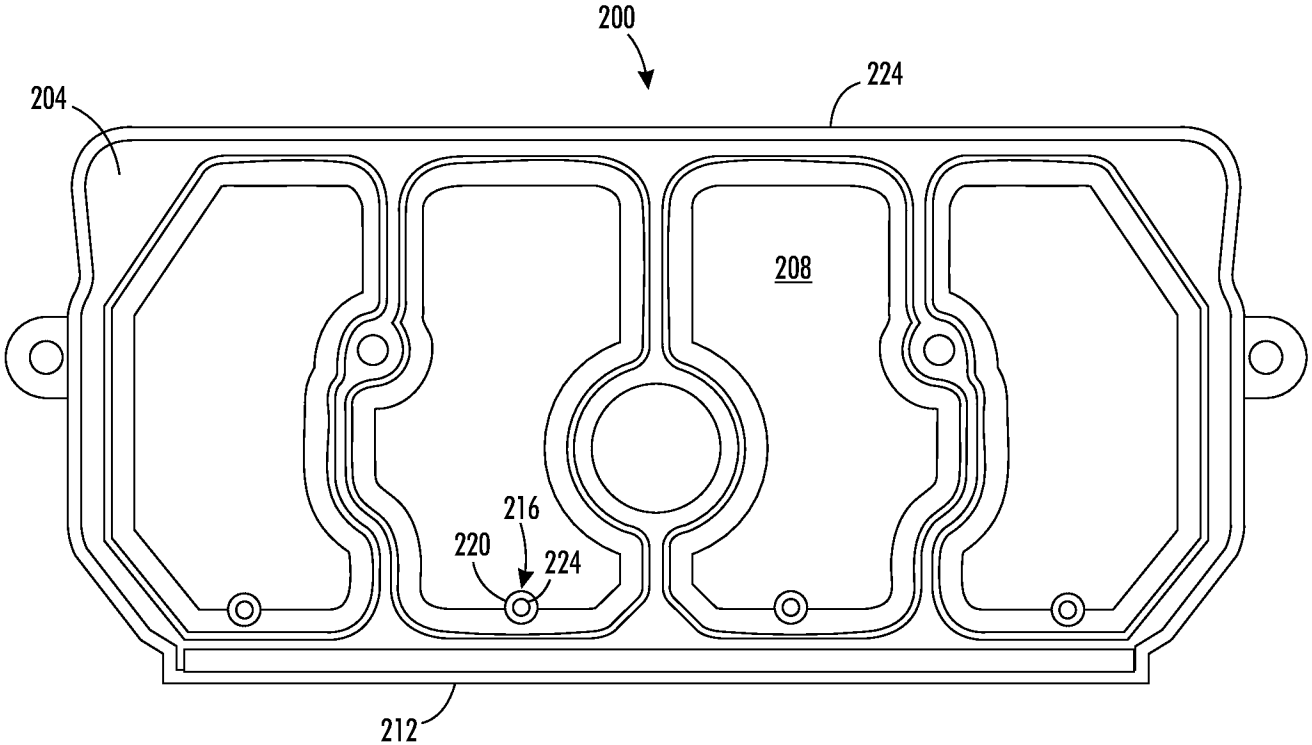
FIG. 2 is a cross-sectional view of an ink manifold housing.

An alternative structure for controlling heat transfer within a print head is depicted in FIG. 2. In FIG. 2, an ink manifold 200 includes an external housing 204 and reservoirs 208 that hold ink separately from one another. The manifold housing 204 is formed from a heat conductive material, such as a metal or a heat conductive thermoplastic. A heating element 212 acts as a heat source that heats ink stored in reservoirs 208. The heating element 212 is typically an electrically resistive heating element that may be selectively controlled to maintain a desired temperature within the manifold 200. The heating element allows for control over both the absolute temperature of the reservoirs and the rate of temperature change in the reservoirs 208. This control enables more uniform and directional solidification of the ink starting from the narrow vias 216 and proceeding to the larger reservoirs 208.

Again referring to FIG. 2, an optional insulation layer 224 may also be placed around the housing 204. The insulation layer 224 reduces differences in the rate of heat escape from the thermally conductive housing 204, which leads to more uniform cooling. The insulation layer 224 operates as a temperature control connector that reduces "hot spots" and "cold spots" that could lead to ink solidifying in an uneven manner in the manifold reservoirs 208. While the insulation layer 224 depicted in FIG. 2 extends over the entire manifold housing 204, the insulation may also be placed over selected portions of the manifold housing 204 in order to achieve a uniform rate of heat conduction.

FIG. 2 also contains vias 216 that convey ink from reservoirs 208 to other chambers in the print head. As in FIG. 1, these vias have a shape that is wider at the opening 120 at one end of the via 116 and which tapers to a narrower opening 124 at the other end of the via. The direction of the taper is selected to control how ink in the via 216 solidifies as it cools. The taper acts as a different form of temperature control connector, allowing the ink in the via 216 to cool in a predictable manner. The preferred selection is for the narrow end of each via to be disposed towards the portion of the print head where ink should solidify first, since the narrower portions of the via 216 have a lower thermal mass of ink that solidifies prior to the wider portions of the via.

Figure 3:
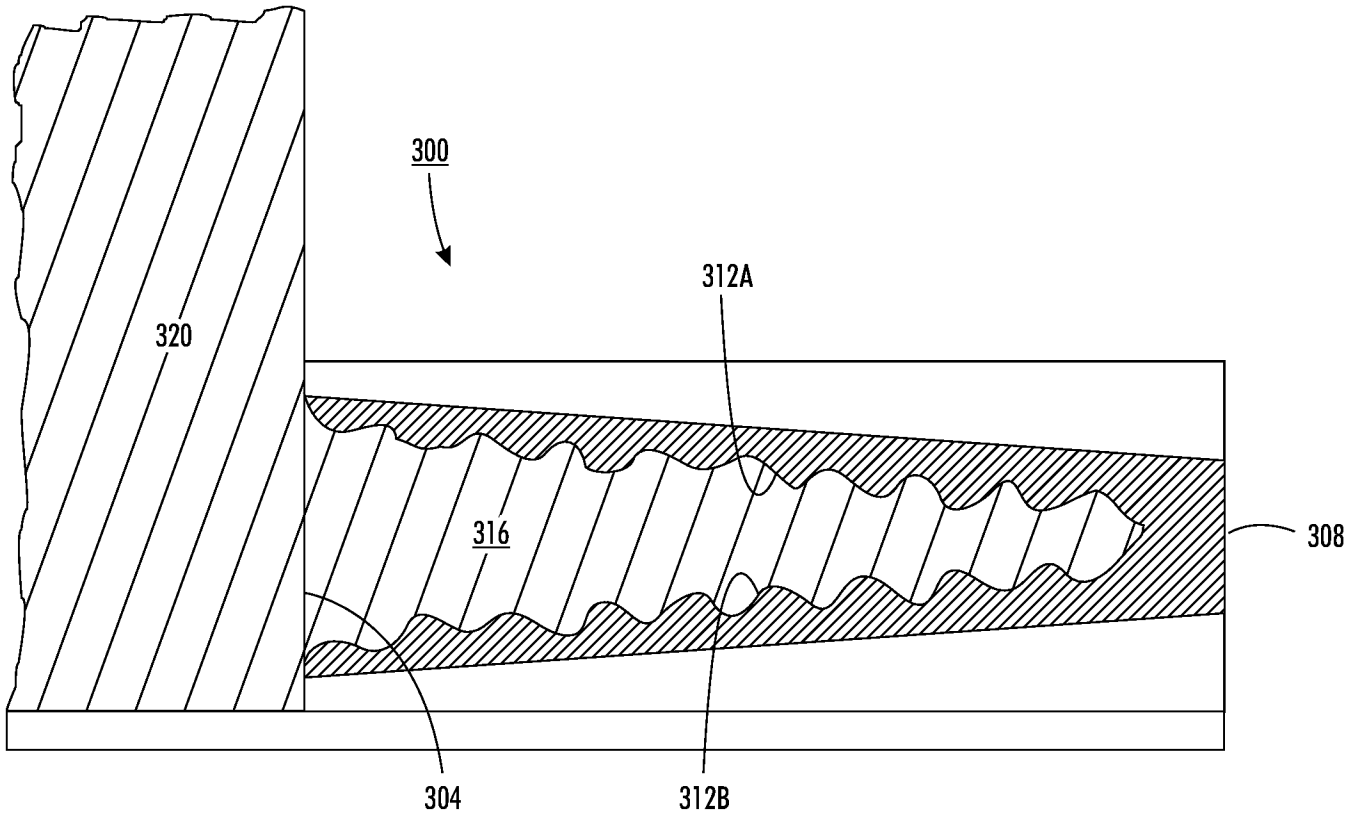
FIG. 3 is a partial cross-sectional view of a print head including a tapered passage and portion of a reservoir.

An example of a tapered via used in the embodiments of FIG. 1 and FIG. 2 is depicted in FIG. 3. The via 300 has a wider opening 304 that tapers to a narrower opening 308. In the example of FIG. 3, ink near the walls of the via solidify first forming solidifying fronts 312A and 312B. The tapered shape of the via means that the portions of ink proximate to the narrow opening 308 have a lower thermal mass and solidify more quickly. This shape enables directional solidification to start at the narrow opening 308 and move towards the wide opening 304. Some forms of ink contract as they solidify, which can cause voids to form if no liquid ink is present to fill the voids. If contraction occurs in the structure of FIG. 3, the liquid ink in the reservoir 320 generates a positive back pressure that enables liquid ink to flow into the via 300 from the reservoir 320 to form a thermal mass 316 that fills voids between the solidified fronts 312A and 312B until the solidification process is complete. Because the reservoir 320 has a larger thermal mass than the narrow via 300, the ink held in the reservoir solidifies after ink the in via 300. Consequently, the reservoir 320 acts as a riser that provides additional liquid ink to fill any voids formed in via 300 during the solidification process.

An ink reservoir and ink conduit adapted to supply liquid ink to the print heads of FIG. 1 and FIG. 2 is depicted in FIG.

Figure 4:
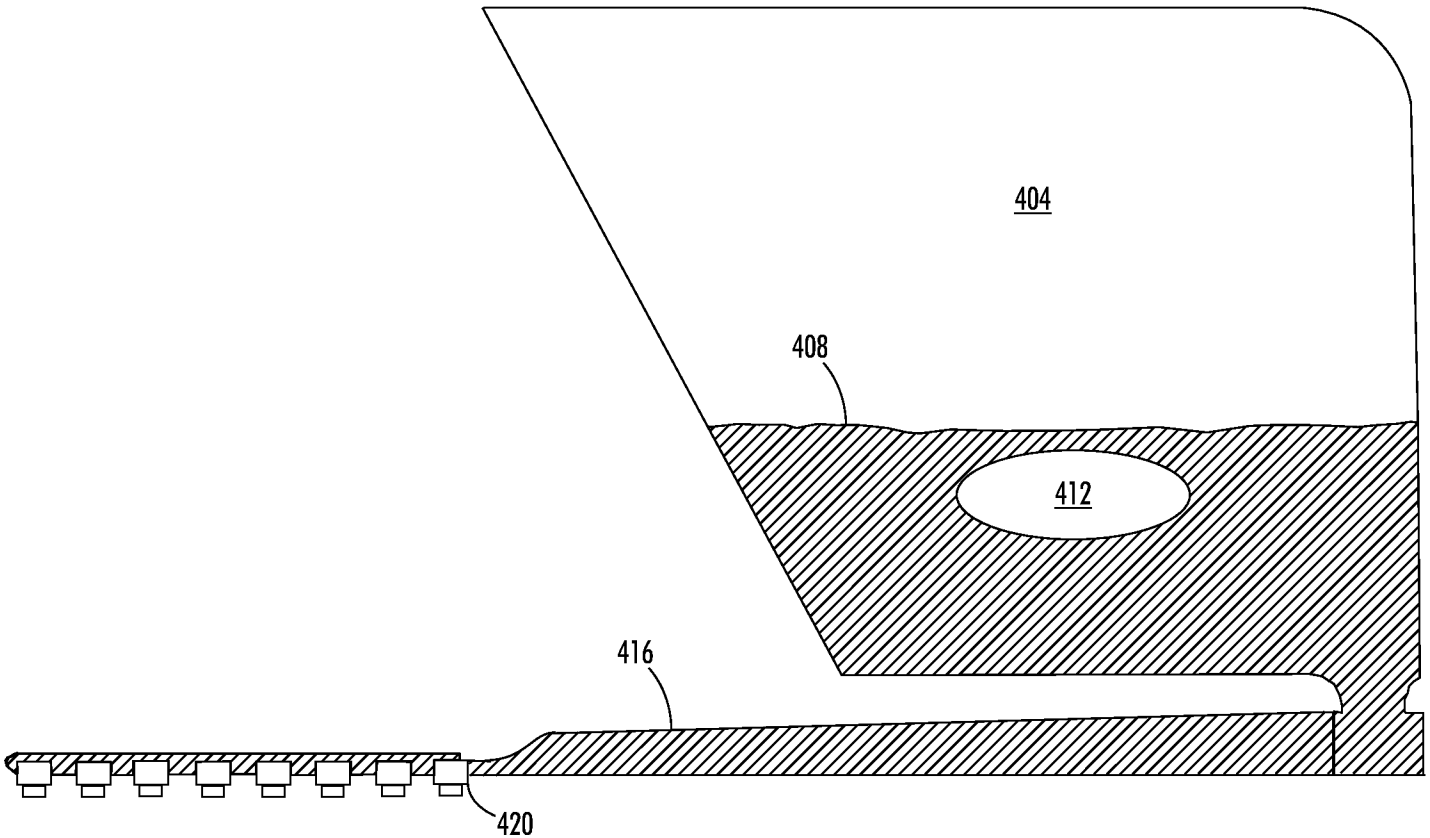
FIG. 4 is a cross-sectional view of an ink reservoir configured to convey ink to one or more print heads.

4. The ink reservoir 404 holds ink 408 that may be solid or liquid depending upon the operational mode of the printer, with the example of FIG. 4 depicting solidified ink. The reservoir 404 is connected to print heads 420 using a tapered connector 416. In a similar manner to the via 300 depicted in FIG. 3, the tapered connector 416 promotes directional solidification of ink from the narrow end proximate to print heads 420 to the wide end proximate to ink reservoir 404. The ink reservoir 404 holds a thermal mass that is larger than the thermal mass in the connector 416. Thus, the ink reservoir 404 acts as a positive pressure generating riser that enables ink to flow into the tapered connector 416 to fill voids that may occur in the solidifying fronts forming the connector 416. Consequently, the melted ink solidifies in a continuous mass free of voids or bubbles that rise to the surface of the mass inside the reservoir 404. If any bubbles form, they form within the larger reservoir 404 as shown at 412. In operation, bubbles in the reservoir 404 are eliminated when the solidified ink 408 is melted, preventing air bubbles from reaching the print heads 420.

It will be appreciated that various of the above-disclosed and other features, and functions, or alternatives thereof, may be desirably combined into many other different systems or applications. A few of the alternative implementations may comprise various combinations of the methods and techniques described. Various presently unforeseen or unanticipated alternatives, modifications, variations, or improvements therein may be subsequently made by those skilled in the art, which are also intended to be encompassed by the following claims.

The invention claimed is:

1. A component for holding melted ink in a solid ink printing system comprising:

a housing;

a passage within the housing that is configured to store melted ink; and a thermal conductor mounted to the exterior of the housing and mechanically coupled to the housing and passage, the thermal conductor being configured to mitigate void formation in melted ink as the melted ink cools in the passage.

2. The component of claim 1 further comprising:

a heat sink mechanically connected to the thermal conductor to dissipate heat conducted by the thermal conductor from the melted ink within the passage.

3. The component of claim 1 wherein the thermal conductor is also mechanically connected to a heat source to enable heat to flow to the melted ink within the passage as the melted ink cools within the passage.

4. A component for holding melted ink in a solid ink printing system comprising:

a housing;

a passage within the housing that is configured to store melted ink; and a thermal conductor extending through an exterior of the housing and mechanically coupled to the housing and passage, the thermal conductor being configured to mitigate void formation in melted ink as the melted ink cools in the passage.

5. The component of claim 4 further comprising:

a heat sink mechanically connected to the thermal conductor to dissipate heat conducted by the thermal conductor from the melted ink within the passage.

6. The component of claim 4 wherein the thermal conductor is also mechanically connected to a heat source to enable heat to flow to the melted ink within the passage as the melted ink cools within the passage.

7. A print head for ejecting melted ink onto an image receiving substrate comprising:

a housing;

a reservoir within the housing that is configured to store melted ink for ejection from the print head; and a thermal control element that is mounted to an exterior of the housing at a position to thermally couple the thermal control element to the melted ink within a portion of the reservoir to enable the thermal control element to dissipate heat from the melted ink within the portion of the reservoir.

8. The print head of claim 7 further comprising:

a heat sink mechanically connected to the thermal control element to dissipate heat conducted by the thermal control element from the melted ink within the portion of the reservoir.

9. The print head of claim 7 further comprising:

a heat conductor mechanically connected to a heat source to supply heat to the melted ink within a passage in the print head as the melted ink cools within the passage.

10. The print head of claim 7 further comprising:

a taper within a portion of a passage in the print head to control heat dissipation from melted ink within the passage.

11. A print head for ejecting melted ink onto an image receiving substrate comprising:

a housing;

a reservoir within the housing that is configured to store melted ink for ejection from the print head; and a thermal control element that is mounted to extend through an exterior of the housing to a position proximate the reservoir to thermally couple the thermal control element to the melted ink stored within the reservoir to control solidification of the melted ink within the reservoir.

12. The print head of claim 11 wherein the thermal control element is mounted to extend through the exterior of the housing to a position within the reservoir.

13. The print head of claim 11 further comprising:

a heat sink mechanically connected to the thermal control element to dissipate heat conducted by the thermal control element from the melted ink within the portion of the reservoir.

14. The print head of claim 11 further comprising:

a heat conductor mechanically connected to a heat source to supply heat to the melted ink within a passage in the print head as the melted ink cools within the passage.

15. The print head of claim 11 further comprising:

a taper within a portion of a passage in the print head to control heat dissipation from melted ink within the passage.

* * * * *